US006609946B1

(12) United States Patent
Tran

(10) Patent No.: US 6,609,946 B1
(45) Date of Patent: Aug. 26, 2003

(54) METHOD AND SYSTEM FOR POLISHING A SEMICONDUCTOR WAFER

(75) Inventor: Minh Quoc Tran, Milpitas, CA (US)

(73) Assignee: Advanced Micro Devices, Inc., Sunnyvale, CA (US)

( * ) Notice: Subject to any disclaimer, the term of this patent is extended or adjusted under 35 U.S.C. 154(b) by 0 days.

(21) Appl. No.: 09/616,473

(22) Filed: Jul. 14, 2000

(51) Int. Cl.[7] ..... B24B 49/00

(52) U.S. Cl. ..... 451/5; 451/8; 451/41; 451/285

(58) Field of Search ..... 451/5, 8, 6, 10, 451/41, 285, 287, 288

(56) References Cited

U.S. PATENT DOCUMENTS 5,450,205 A * 9/1995 Sawin et al. ..... 356/382
5,695,660 A * 12/1997 Litvak ..... 216/85
6,271,047 B1 * 8/2001 Ushio et al. ..... 451/6
6,301,009 B1 * 10/2001 Tinker ..... 356/511
2001/0000497 A1 * 4/2001 Epshteyn et al. ..... 438/691

* cited by examiner

*Primary Examiner*—M. Rachuba
(74) *Attorney, Agent, or Firm*—Winstead Sechrest & Minick P.C.; Robert A. Voigt, Jr.

(57) ABSTRACT

The present invention provides a method and system for polishing a wafer surface. The method and system comprises determining whether a thickness of the wafer surface is uniform while the wafer surface is being polished, and adjusting the polishing process while the wafer surface is being polished based on the determination of whether the thickness of the wafer surface is uniform. Through the use of the method and system in accordance with the present invention, in-situ adjustments can be made to the CMP polishing process while the wafer is actually being polished. This results in a substantial improvement in polishing uniformity.

15 Claims, 3 Drawing Sheets

METHOD AND SYSTEM FOR POLISHING A SEMICONDUCTOR WAFER

FIELD OF THE INVENTION

The present invention relates generally to semiconductor manufacturing and specifically to a method and system for polishing a semiconductor wafer.

BACKGROUND OF THE INVENTION

In the fabrication of integrated circuits (ICs), it is often necessary to polish a thin flat wafer of semiconductor material. In general, a semiconductor wafer is polished in order to provide a planarized surface. This polish serves to remove topography of a deposited film generated by underlying layers during IC fabrication as well as surface defects such as scratches, roughness, embedded particles, or crystal lattice damage. This polishing process is often referred to as chemical mechanical planarization (CMP) and is utilized to improve the quality and reliability of semiconductor integrated circuits. The CMP process is usually performed during the formation of various devices and integrated circuits on the wafer.

In general, the chemical mechanical planarization process involves holding a wafer under down force against a moving polishing pad. The polishing pad is adhered typically on top of a rotating platen and wetted with slurry. The slurry contains abrasives such as alumina or silica, and chemicals to effect easier removal of the material being polished, and attain a surface as smooth and defect-free as possible. A rotating polishing head or wafer carrier is typically utilized to hold the wafer and apply pressure during polish. A backing film is optionally positioned between the wafer carrier and the wafer to improve polish uniformity.

CMP processes have been used to polish surfaces that are made of silicon oxide, silicon nitride, tungsten, aluminum, copper, etc. Inherent imperfection and a degree of unrepeatability in the process cause non-uniformity in the removal amount or post-polish film thickness. The process parameters to be adjusted in a CMP process include, for example, polish time, platen speed, head speed, slurry flow rate, and applied force. The applied force can be applied on some current polishers over many zones across the wafer. By adjusting the process parameters, a highly non-uniform process can be tuned to produce improved uniformity. Conventionally, such process tuning is done on a post-priori, or ex-situ, manner, i.e., by measurements of film thickness and uniformity after the polish process is completely finished to determine the process profile, and then adjusting process parameters for improvement of the result if desired. There is no available technique that exists today that will allow the semiconductor manufacturer to measure, obtain a feedback, and adjust and control process parameters during the polish.

Conventional polishing methods utilize an optical endpoint detector to track the thickness of the wafer during the polishing process. The technology of optical endpoint detection is described in the following publications: (1) N. E. Lustig et al., "In-situ endpoint detection and process monitoring method and apparatus for chemical-mechanical polishing," U.S. Pat. No. 5,433,651 (1995); (2) Y. Ushio et al., "In-situ monitoring of CMP process utilizing 0-order spectrometry," Proceedings of CMP-MIC Conference, 23 (1999).

The optical endpoint detector utilizes an optical signal to sample the thickness of transparent film on a wafer during the wafer's relative motion across an endpoint window in the polishing pad. The optical endpoint operates by impinging light from a source below the pad through the endpoint window at a wafer being polished and detecting the light reflected from the wafer. By observing optical interference, the film thickness of transparent materials can be determined. The endpoint is achieved when the film thickness reaches the targeted value.

When the material being removed is opaque rather than transparent, such as for metal films (tungsten, copper, etc.), a dramatic change in the intensity of the reflected light is observed when the polished film is almost cleared or cleared and the underlying film (normally a dielectric material such as silicon oxide, silicon nitride) is exposed. Thick metal films have high reflectance, where as the dielectric material have lower reflectance. If the impinging light has many wavelengths, a change of color of the film as it is almost cleared is also observed, signaling that endpoint is reached.

For a further description of the conventional methodology, please refer to FIG. 1. FIG. 1 is an illustration of the conventional polishing process. For purpose of easier understanding, a linear polisher is illustrated. The optical endpoint signal samples the film thickness of the wafer 10 through the endpoint window 12. For this type of polisher, the sample is taken once per pass of the endpoint window, the signal being averaged over areas from one edge of the wafer to the other edge. (Here for a simplified discussion, we have neglected wafer rotation, and the two wafer edges where the endpoint window enters and exits underneath the wafer are opposite each other. In general, they are not on the same diameter line through the center.) As such, no spatial resolution is obtained to ascertain the polish profile (e.g., edge fast or edge slow) during polish. Post-polish measurements are required to obtain this polish profile and before any process adjustment can be made. Such method of control is ex-situ, requiring human intervention Accordingly, what is needed is a more effective method and system for sampling the thickness of film layers on wafers that facilitates in-situ adjustments of the polish parameters during process. The method and system should be simple, cost effective, and adaptable to existing technology. The present invention addresses such a need.

SUMMARY OF THE INVENTION

The present invention provides a method and system for polishing a wafer surface. The method and system comprises determining whether a thickness of the wafer surface is uniform while the wafer surface is being polished, and adjusting the polishing process while the wafer surface is being polished based on the determination of whether the thickness of the wafer surface is uniform.

Through the use of the method and system in accordance with the present invention, in-situ adjustments can be made to the CMP polishing process while the wafer is actually being polished. This results in a substantial improvement in polishing uniformity.

DETAILED DESCRIPTION

The present invention relates to a method and system for polishing a semiconductor wafer. The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

The method and system in accordance with the present invention is described in the context of a preferred embodiment. The preferred embodiment of the present invention facilitates in-situ adjustments of the polish parameters during the polishing process by utilizing the optical endpoint signal to determine whether the semiconductor wafer is being polished in a uniform fashion. Once the determination is made regarding the uniformity of the wafer, process controls are employed to adjust the polishing parameters (head speed, platen speed, slurry flow, downward pressure, etc.) while the wafer is being polished. By adjusting the polishing parameters while the wafer is being polished, the uniformity of the polished wafer is substantially improved.

As previously stated, the optical endpoint is utilized to determine whether the semiconductor wafer is being polished in a uniform fashion. In order to accomplish this, the optical endpoint signal samples the thickness of the film on the wafer during the polishing process at a high rate of speed. Preferably, this rate is every microsecond. This is called fast sampling. By fast sampling the film thickness, a determination could be made in-situ as to whether the polishing process is edge-fast or edge-slow. Conventional methodology is unable to determine whether polishing process is edge-fast or edge-slow because during the time period when the optical endpoint signal samples the thickness of the wafer, a large portion of the wafer traverses by the endpoint window and the signal detected is then averaged over this large portion.

Figure 1:
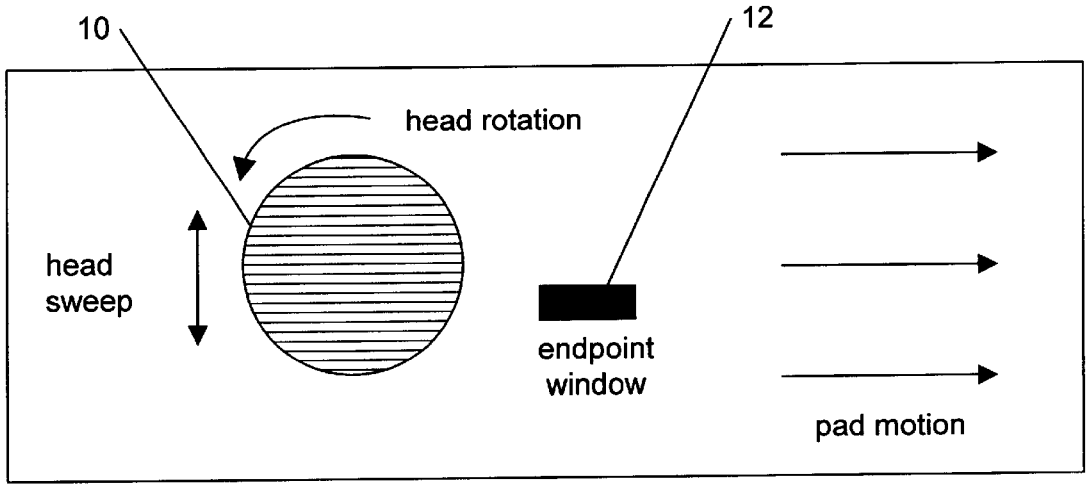
FIG. 1 Prior Art
FIG. 1 is an illustration of the conventional polishing process.
Figure 2:
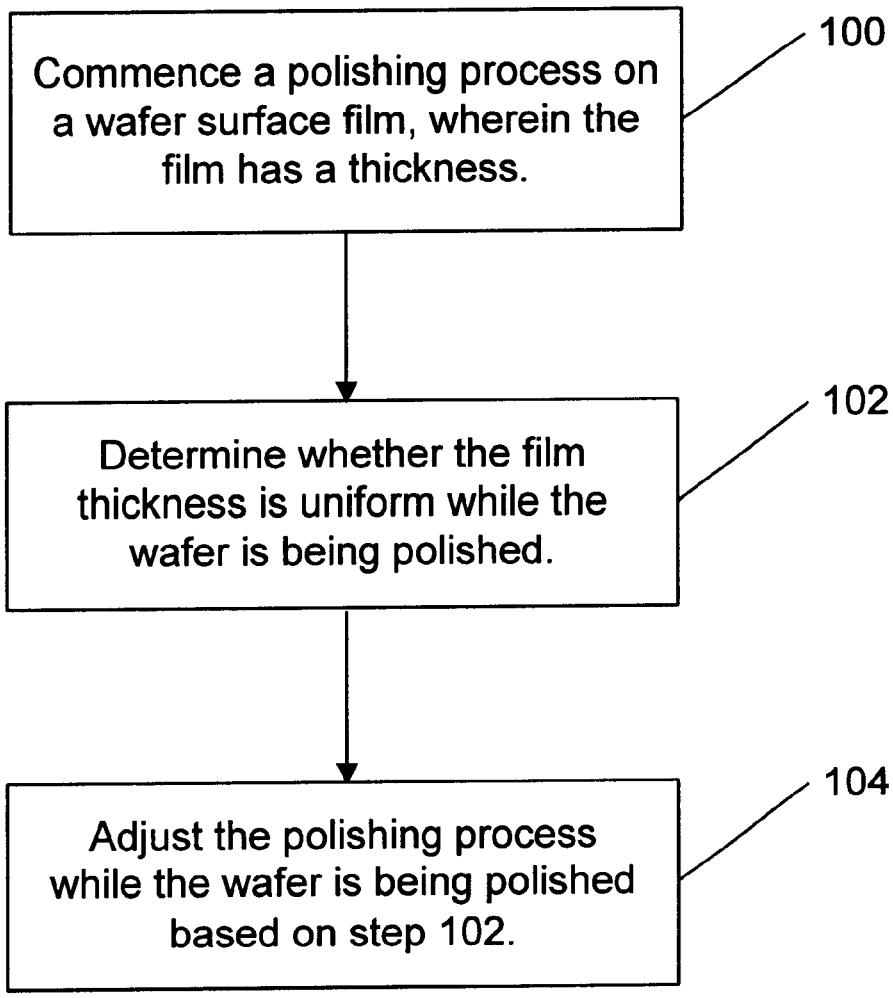
FIG. 2 is a flowchart of the method of polishing a wafer surface in accordance with the present invention.

For a better understanding of the present invention, please refer to FIG. 2. FIG. 2 is a flowchart of the method of polishing a wafer surface in accordance with the present invention. The method begins by commencing a polishing process on the wafer surface, via step 100. A determination is then made as to whether the film polished is being removed in a uniform fashion while the wafer surface is being polished, via step 102. Preferably, this determination is accomplished by utilizing the optical endpoint signal to fast sample the thickness of the wafer surface.

Figure 3:
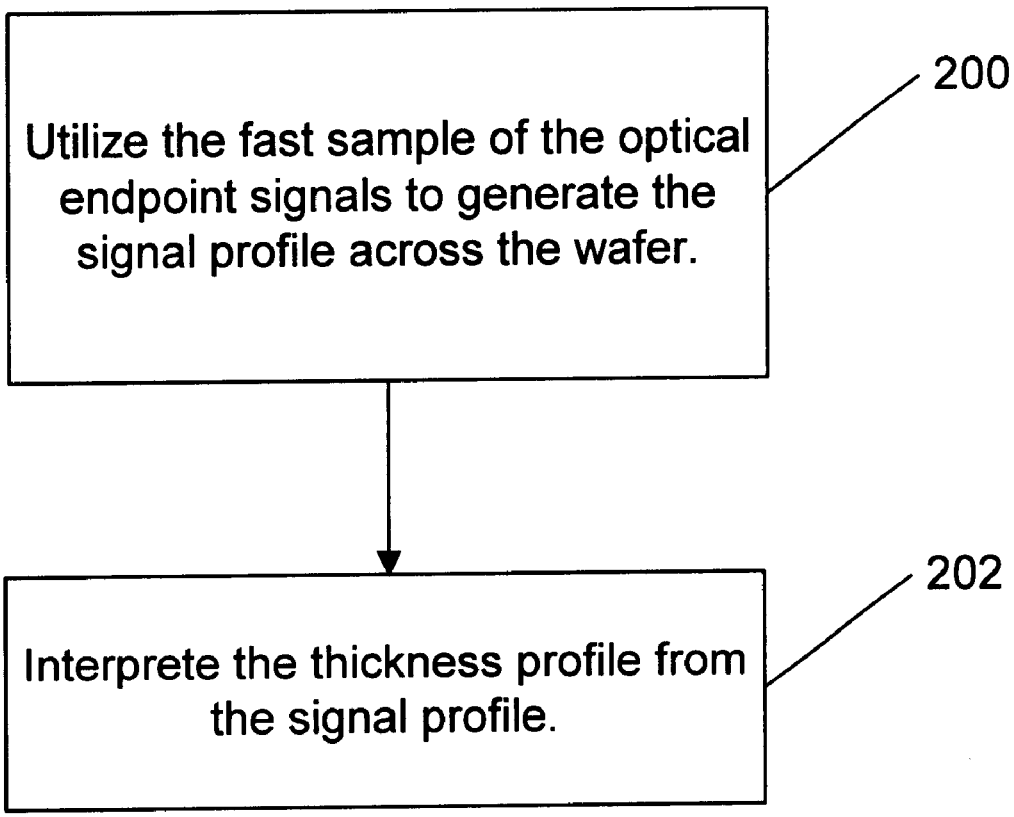
FIG. 3 is a flowchart further illustrating the determination as to whether the wafer surface is being polished in a uniform fashion while the wafer surface is being polished.

For a further description of the method in accordance with the present invention, please refer to FIG. 3. FIG. 3 is a flowchart further describing step 102 of the flowchart of FIG. 2. First, fast sampling of the optical endpoint signal is utilized to generate the signal profile across the wafer, via step 200. In this step, the trajectory of the endpoint window relative to the wafer is modeled to correlate the samples with positions on the wafer, thereby generating a signal profile. Next, the thickness profile is interpreted from the signal profile, via step 202. The thickness profile indicates whether the process is edge fast, or edge slow, or some other non-uniform pattern (e.g., donut shape).

Referring back to FIG. 2, the polishing process is adjusted while the wafer is being polished based on the determination of step 102, via step 104. Here, process controls are employed to adjust the polishing parameters of the polisher to compensate for a non-uniform polishing pattern. These process controls are utilized to adjust the polishing parameters (downward pressure, head speed, platen speed, etc.) if the process is, for example, edge fast. (A description of how head speed and platen speed affect the uniformity of removal rates within a wafer is given by B. U. Yoon et al. in "The Effects of Platen and Carrier Rotation Speeds on Within Wafer Non-Uniformity of CMP Removal Rate," Proceedings of the CMP-MIC Conference, 193 (1998). A more general description of the kinetics of polishers is given by K. Yang, Advanced Micro Devices, Inc., Internal Report, 1995.).

Referring back to FIG. 2, the polishing process is adjusted while the wafer is being polished based on the determination of step 102, via step 104. Here, process controls are employed to adjust the polishing parameters of the polisher to compensate for a non-uniform polishing pattern. These process controls are utilized to adjust the polishing parameters (downward pressure, head speed, platen speed, etc.) if the process is, for example, edge fast.

Through the use of the method and system in accordance with the present invention, in-situ adjustments can be made to the CMP polishing process. By determining how non-uniform the process is while the wafer is actually being polished, the polisher can be adjusted accordingly during the polish. This results in a substantial improvement in polishing uniformity.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A method for polishing a wafer comprising the steps of:

a) determining whether a thickness of the wafer surface is uniform while the wafer surface is being polished, wherein step a) further comprises:

a1) fast sampling the thickness of the wafer surface while the wafer surface is being polished; and a2) determining a characterization of the polishing process; and b) adjusting the polishing process while the wafer surface is being polished based on step (a).

2. The method of claim 1 wherein the thickness of the wafer surface is sampled at a rate of every microsecond.

3. The method of claim 1 the characterization is non-uniform.

4. The method of claim 3 wherein the non-uniform characterization is edge fast.

5. The method of claim 3 wherein the non-uniform characterization is edge slow.

6. The method of claim 1 wherein step b) further comprises:

b1) adjusting at least one of a plurality of polishing parameters based on the characterization of the polishing process.

7. A system of polishing a wafer surface comprising:

means for determining whether the thickness of the wafer surface is uniform while the wafer surface is being polished; and means for adjusting the polishing process while the wafer surface is being polished based on whether the thickness of the wafer surface is uniform, wherein the means for determining whether the thickness of the wafer surface is uniform further comprises:

means for fast sampling the thickness of the wafer surface while the wafer surface is being polished; and means for determining a characterization of the polishing process.

8. The system of claim 7 wherein the thickness of the wafer surface is sampled at a rate of every microsecond.

9. The system of claim 7 wherein the characterization is non-uniform.

10. The system of claim 8 wherein the non-uniform characterization is edge fast.

11. The system of claim 8 wherein the characterization is edge slow.

12. The system of claim 8 wherein the means for adjusting the polishing process further comprises:

means for adjusting at least one of a plurality of polishing parameters based on the characterization of the polishing process.

13. The system of claim 8 wherein the means for determining a characterization of the polishing process comprises computer implemented software modeling.

14. The method as recited in claim 6, wherein said at least one of said plurality of polishing parameters comprises at least one of the following: head speed, platen speed, slurry flow, and downward pressure.

15. The system as recited in claim 12, wherein said at least one of said plurality of polishing parameters comprises at least one of the following: head speed, platen speed, slurry flow, and downward pressure.

* * * * *

UNITED STATES PATENT AND TRADEMARK OFFICE

CERTIFICATE OF CORRECTION

PATENT NO. : 6,609,946 B1
DATED : August 26, 2003
INVENTOR(S) : Minh Quoc Tran

It is certified that error appears in the above-identified patent and that said Letters Patent is hereby corrected as shown below:

Column 4,
Please delete lines 13-20.

Signed and Sealed this

Sixteenth Day of March, 2004

JON W. DUDAS
*Acting Director of the United States Patent and Trademark Office*